US008002382B2

(12) United States Patent
Steinfield et al.

(10) Patent No.: US 8,002,382 B2
(45) Date of Patent: Aug. 23, 2011

(54) PRINT HEAD WIPING

(75) Inventors: Steven W. Steinfield, San Diego, CA (US); Chandrasekhar Nadimpalli, San Diego, CA (US); Francisco Lopez Moral, Barcelona (ES); Jason D. Jolly, San Diego, CA (US); Rafael Ulacia Portoles, Sant Cugat del Valles (ES); Maria Dinares Argemi, Terrassa (ES); Curtis N. Torgerson, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 824 days.

(21) Appl. No.: 11/739,604

(22) Filed: Apr. 24, 2007

(65) Prior Publication Data

US 2008/0266342 A1 Oct. 30, 2008

(51) Int. Cl.
*B41J 2/165* (2006.01)

(52) U.S. Cl. ..... 347/33

(58) Field of Classification Search ..... None
See application file for complete search history.

(56) References Cited

U.S. PATENT DOCUMENTS

| | | | | |
|---|---|---|---|---|
| 4,369,456 | A | 1/1983 | Cruz-Uribe et al. | |
| 4,829,318 | A * | 5/1989 | Racicot et al. | 347/33 |
| 4,928,120 | A * | 5/1990 | Spehrley et al. | 347/33 |
| 5,051,761 | A | 9/1991 | Fisher et al. | |
| 6,045,211 | A | 4/2000 | Tokudu | |
| 6,183,060 | B1 | 2/2001 | Tokudu | |
| 6,367,905 | B1 * | 4/2002 | Sharma et al. | 347/33 |
| 6,460,967 | B1 * | 10/2002 | Makita et al. | 347/33 |
| 6,597,436 | B2 * | 7/2003 | Suzuki et al. | 355/407 |
| 6,692,100 | B2 | 2/2004 | Steinfeil et al. | |
| 6,695,429 | B2 | 2/2004 | Barinaga | |
| 6,786,590 | B2 * | 9/2004 | Maki et al. | 347/104 |
| 6,869,161 | B2 | 3/2005 | Wouters et al. | |
| 6,957,881 | B2 | 10/2005 | Nishino | |
| 7,073,886 | B2 * | 7/2006 | Nakamura | 347/33 |
| 7,090,728 | B2 | 8/2006 | Nakamura | |
| 7,497,564 | B2 * | 3/2009 | Yui | 347/101 |
| 2003/0197776 | A1 * | 10/2003 | Ito et al. | 347/213 |
| 2004/0090508 | A1 * | 5/2004 | Chowdry et al. | 347/103 |
| 2006/0209152 | A1 * | 9/2006 | Baringa et al. | 347/104 |
| 2007/0046724 | A1 * | 3/2007 | Jung et al. | 347/33 |

* cited by examiner

*Primary Examiner* — Matthew Luu
*Assistant Examiner* — Alejandro Valencia

(57) ABSTRACT

Various embodiments and methods relating to wiping of a print head are disclosed.

21 Claims, 11 Drawing Sheets

FIG. 5
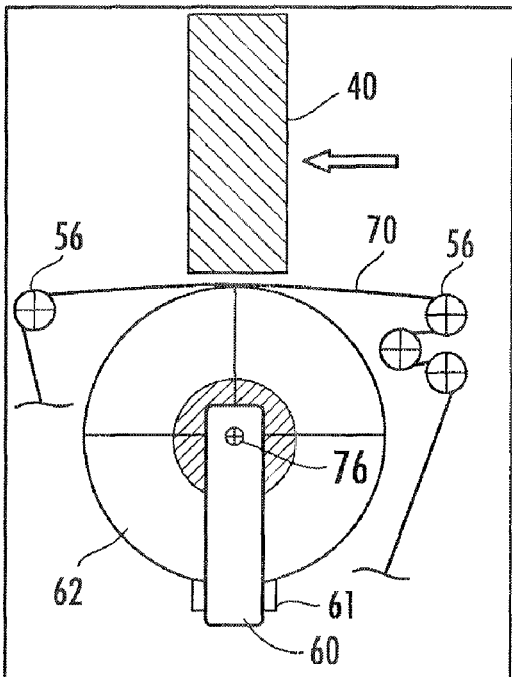
FIG. 6
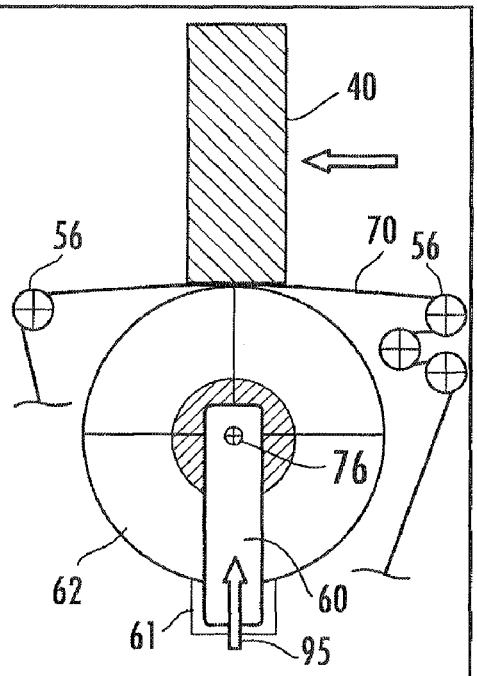
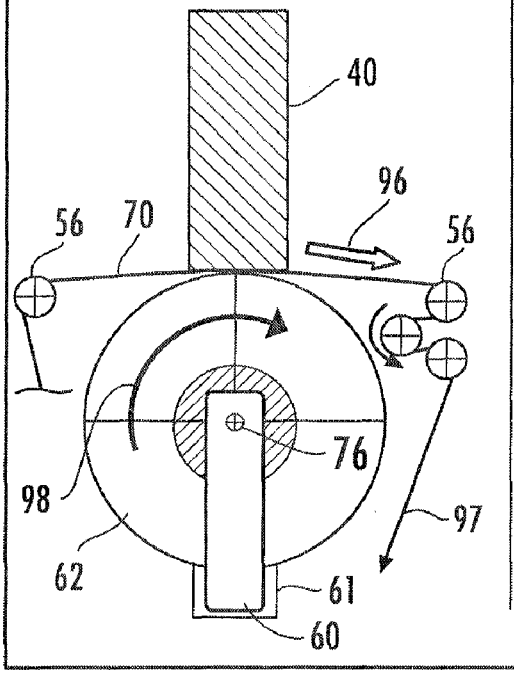
FIG. 7
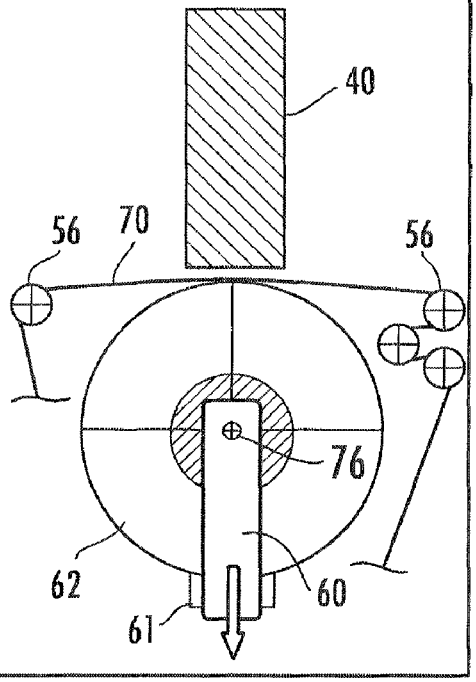
FIG. 8

PRINT HEAD WIPING

BACKGROUND

During printing, fluid residue may build up upon nozzles of the print head. This residue detrimentally impacts printing performance. Servicing of the print head to remove the residue may take time and lower printing throughput.

BRIEF DESCRIPTION OF THE DRAWINGS

FIGS. 5-8 schematically illustrate the service station of FIG. 2 wiping a print head according to an example embodiment.

DETAILED DESCRIPTION OF THE EXAMPLE EMBODIMENTS

Figure 1:
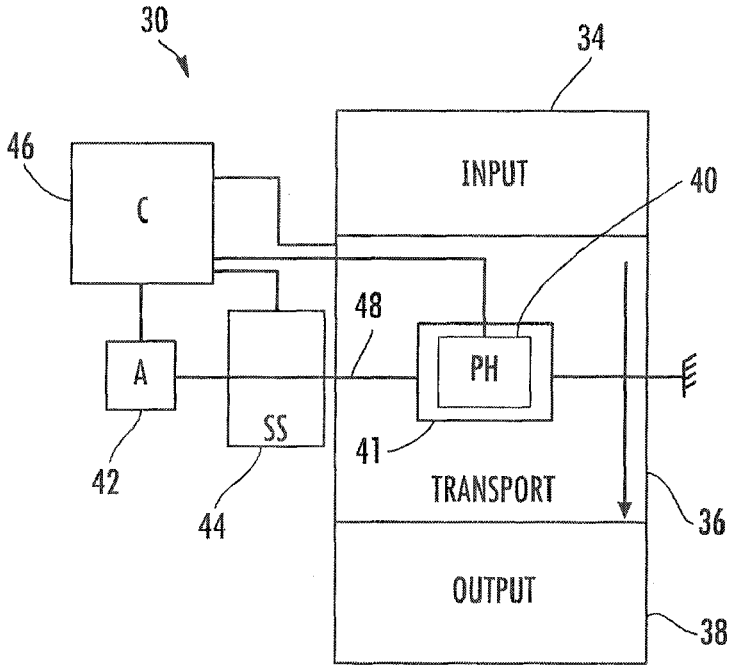
FIG. 1 is a top plan view schematically illustrating a printing system according to an example embodiment.

FIG. 1 is a schematic illustration of a printing system 30 including a service station 44 according to an example embodiment. As will be described hereafter, service station 44 enhances printing performance of printing system 30 while maintaining printing throughput.

Printing system 30 generally includes, input 34, transport 36, output 38, drop-on-demand print head 40, carriage 41, actuator 42, service station 44 and controller 46. Input 34 comprises one or more structures supported by housing 22 configured to store and deliver media to transport 36. In those embodiments in which the media comprises sheets of one or more materials, input 34 may comprise a tray or bin. In other embodiments, where the media is applied as part of a roll, input 34 may comprise a supply roll of media.

Transport 36 comprises a mechanism configured to receive the media from input 34, to deliver or move the media relative to print head 40 and to subsequently move the printed upon media to output 38. In one embodiment wherein the media comprises sheets of material, transport 36 may comprise a series of rollers, belts, movable trays, a drum, robotic arms and the like. In other embodiments, transport 36 may comprise other mechanisms configured to grasp or hold the media as a media is moved with respect to print head 40. In particular embodiments in which the media is manually positioned with respect to print head 40, transport 36 as well as input 34 and output 38 may be omitted.

Output 38 comprises one or more structures configured to receive printed upon media from transport 36. In one embodiment, output 38 may be configured to provide a person with access to be printed upon media. In another embodiment, output 38 may be configured to be connected to another device or transport for further moving the printed upon media to another mechanism for further interaction or treatment. In one embodiment, output 38 may comprise a tray or bin.

Drop-on-demand inkjet print head 40 comprises one or more print heads having a plurality of nozzles 43 (schematically illustrated in FIG. 2) through which fluid is ejected. According to one embodiment, drop-on-demand ink jet print head 40 may comprise a thermoresistive print head. In another embodiment, print head 40 may comprise a piezo resistive print head. According to one embodiment, print head 40 may be part of a cartridge which also stores the fluid to be dispensed. In another embodiment, print head 40 may be supplied with fluid by an off-axis ink supply.

Carriage 41 comprises a structure movably supporting print head 40. In one embodiment, carriage 41 comprises a structure configured to slide or move along a guide 48, such as a rod, bar or rack gear. In one embodiment, carriage 41 is configured to removably receive print head 40. In other embodiments, carriage 41 may have other configurations.

Actuator 42 comprises a mechanism operably coupled to carriage 41 while being configured to move carriage 41 and print head 40 between a printing position in which print head 40 is located opposite to a media positioned by transport 36 and a second position in which print head 40 is located opposite to service station 44 for servicing of print head 40 (shown in FIG. 1). Actuator 42 may comprise a motor operably coupled to print head 40 by a drive train or transmission. In other embodiments, actuator 42 may comprise an electric solenoid, or hydraulic or pneumatic cylinder assembly.

Figure 2:
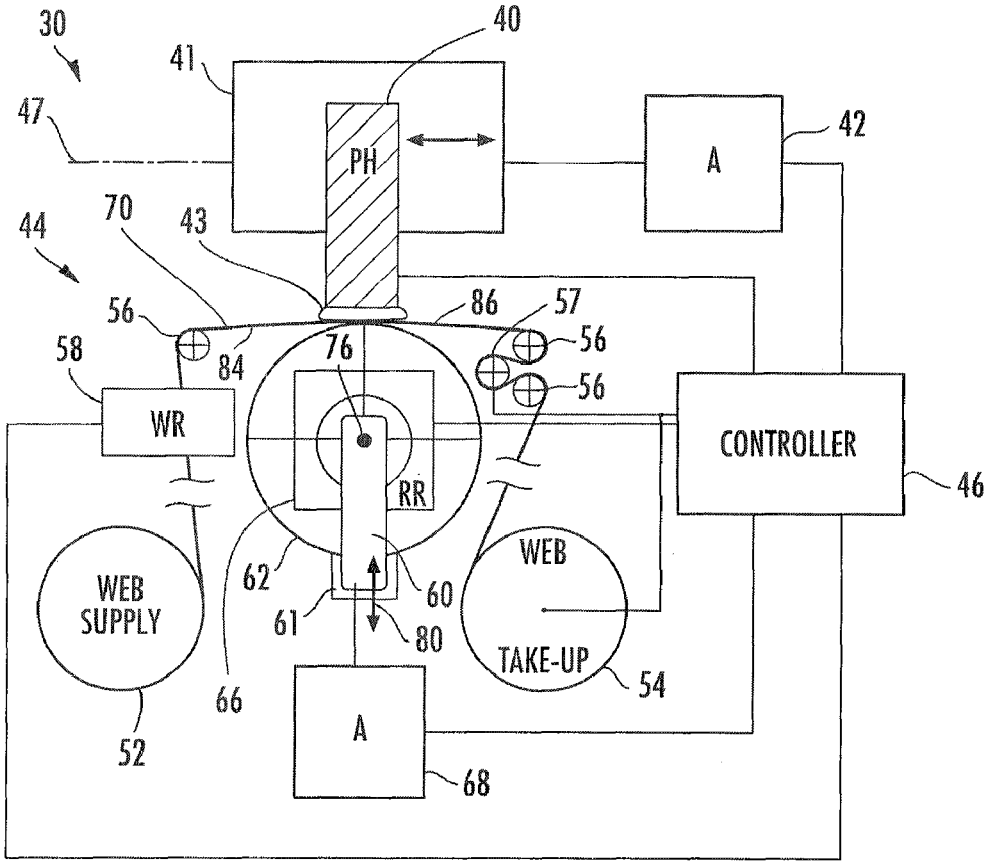
FIG. 2 is a front view schematically illustrating a service station of the printing system of FIG. 1 according to an example embodiment.

Service station 44 comprises an arrangement of components configured to service print head 40. Examples of servicing operations include, but are not limited to, spitting, priming and wiping. FIG. 2 illustrates service station 44 in more detail. As shown by FIG. 2, service station 44 includes web supply 52, web take-up 54, web supports 56, web drive 57, web retainer 58, support 60, guide 61, roller 62, roller retainer 66 and actuator 68.

Web supply 52 and web take-up 54, both of which are schematically shown in greatly reduced proportions for purposes of illustration, facilitate use of a web of cleaning or wiping material 70. Wiping material 70 comprises a continuous length of flexible material configured to be pressed against nozzles 43 of print head 40 to wipe print head 40. In one embodiment, material 70 is configured to absorb fluid. For example, in one embodiment, material 70 may comprise a non-woven polymeric material such as EVOLON commercially available from Freudenberg Group of Freudenberg & Co. of Weinheim an der Bergstrasse, Germany. In other embodiments, material 70 may comprise other non-woven polymeric or non-polymeric materials. In still other embodiments, material 70 may comprise a woven material.

Web supply 52 comprises a spool or roll of substantially clean and unused wiping material. Web take-up 54 comprises a spool or spindle about which used wiping material 70 is wound. In the embodiment illustrated, web take-up 54 is maintained under controlled tension.

Web supports 56 comprise one or more rollers or other structures configured to extend material 70 such that material 70 spans two of supports 56 across roller 62. Web supports 56 maintain material 70 in tension during wiping of print head 40. Although service station 44 is illustrated as including three such supports comprising rollers in the illustrated arrangement, in other embodiments, service station 44 may have a greater or fewer of such supports 56, such supports may comprise other structures and maybe provided in other arrangements.

Web drive 57 comprises an actuator configured to drive the web of material 70 from web supply 52 across roller 62 to web take-up 54. In the example illustrated, web drive 57 engages material 70 between supports 56. In the example illustrated, web drive 57 includes a motor rotationally driving a roller in engagement with material 70. In the example illustrated, web drive 57 is further operably coupled to web take-up 54 by a gear transmission, a slip clutch, and a torsional spring (not shown). The torsional spring, which only winds to a certain tension depending on the setting of the slip clutch, maintains web take-up 54 at a controlled tension. The slip clutch is driven passively by the powertrain from web drive 57. In other embodiments, other mechanisms may use to drive the web of material 70 or web take-up 54.

Web retainer 58 comprises a mechanism configured to appropriately inhibit movement of material 70 while material 70*s* contacting print head 40 and while print head 40 is being moved relative to roller 62 by actuator 42. Web retainer 58 reduces an amount of material 70 that is dragged or unwound from web supply 52 during such wiping. In one embodiment, web retainer 58 may comprise a passive web brake using a one-way clutch. In other embodiments, web retainer 58 may be selectively actuatable between a web braking or retaining active state in which unwinding of material 70 from supply 52 is inhibited and an inactive state in which material 70 more easily unwinds from supply 52, such as when web take-up 54 is moving material 70 across print head 40. In other embodiments, web retainer 58 may have other configurations or may be omitted.

Roller support 60 comprises one or more structures configured to rotationally support roller 62 about axis 76. Guide 61 (schematically represented) comprises a structure configured to cooperate with support 60 so as to guide movement up support 60 to facilitate translation of roller 62 and the axis 76 about which roller 62 rotates in the directions indicated by arrows 80. As a result, support 60 facilitates translation of roller 62 towards and away from material 70 spanning between supports 56 and print head 40. Although support 60 is illustrated as linearly translating roller 62 in a single direction perpendicular to material 70 and nozzles 43, in another embodiment, guide 61 may alternatively be configured to facilitate translation of support 60 and roller 62 along multiple linear segments or along an arcuate path towards or away from material 70 and print head 40. In yet other embodiments, support 60 may alternatively be stationary or fixed while rotationally supporting roller 62 for rotation about axis 76.

Roller 62 comprises an elongate substantially cylindrical member extending along and rotationally supported about axis 76. Roller 62 is configured to be pressed against a first side 84 of material 70 while being located opposite to print head 40 so as to urge and press side 86 of material 70 into wiping contact with nozzles 43 of print head 40. In the particular example illustrated, roller 62 is configured to press material 70 against nozzles 43 to facilitate cross wiping of nozzles 43.

Figure 3:
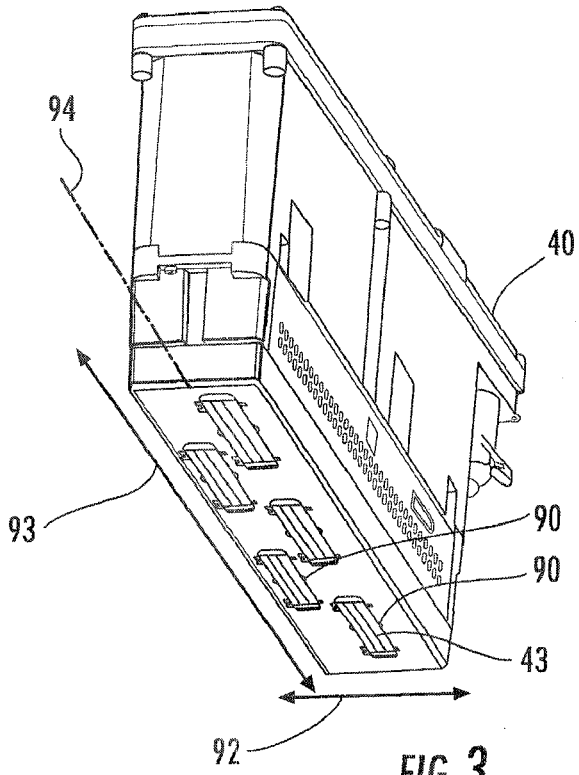
FIG. 3 is a bottom perspective view of one example of a print head of the printing system of FIG. 1 according to an example embodiment.
Figure 4:
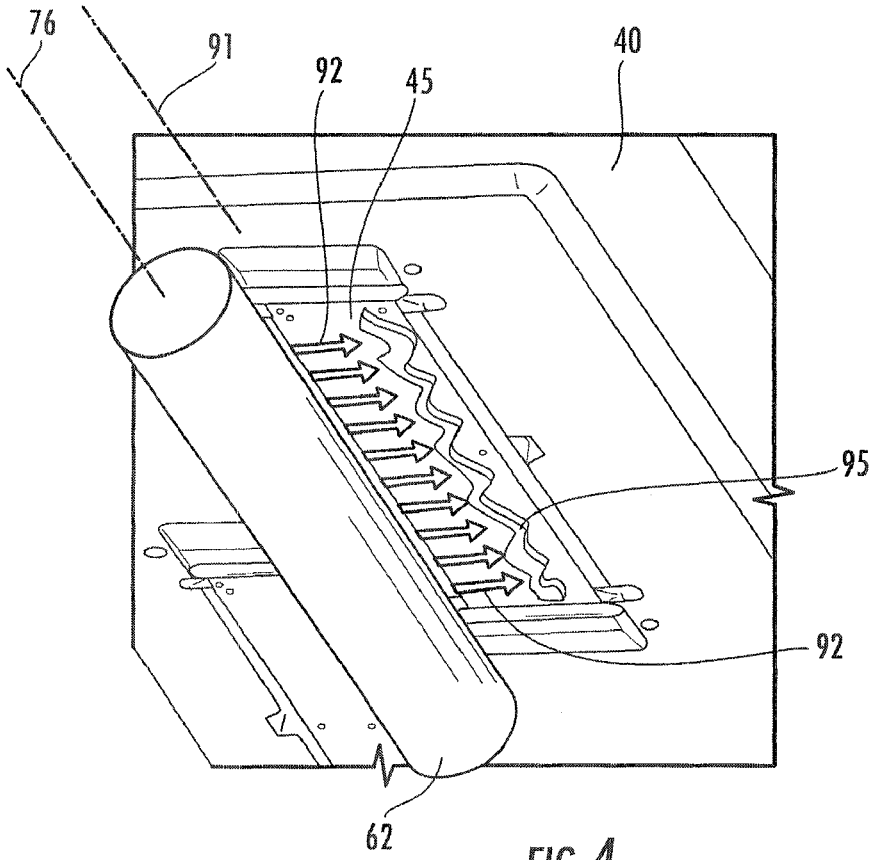
FIG. 4 is an enlarged fragmentary perspective view of the service station of FIG. 2 wiping the print head of FIG. 3 with portions omitted for purposes of illustration according to an example embodiment.
Figure 12:
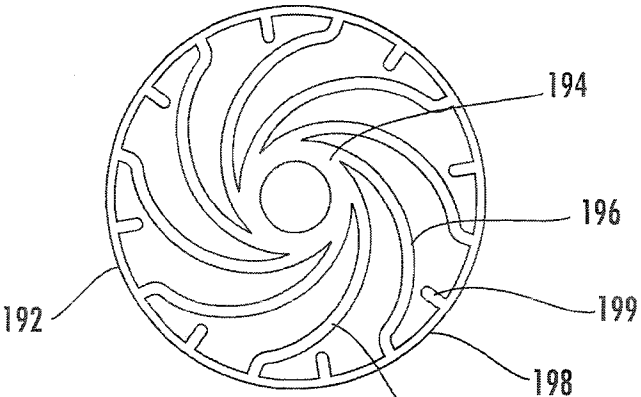
FIGS. 9-12 are end views illustrating various embodiments of a roller of the service station of FIG. 2 according to an example embodiment.
Figure 11:
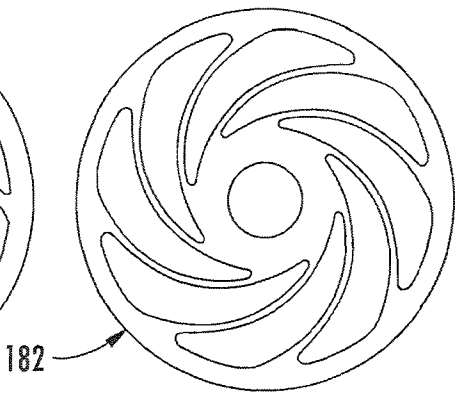
Figure 10:
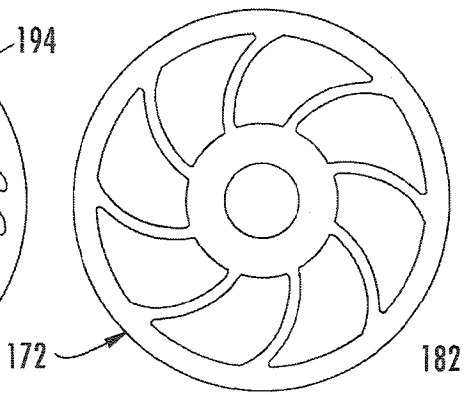
Figure 9:
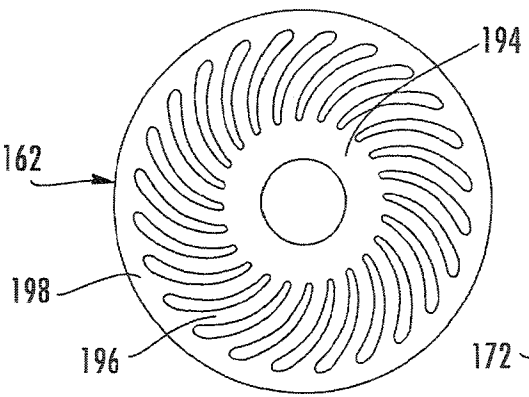

FIGS. 3 and 4 illustrate cross wiping of nozzles 43 using roller 62. FIG. 3 is a perspective view illustrating nozzles 43 of one example of print head 40. In the example shown in FIG. 3, print head 40 includes five staggered individual print heads 90. Each of print heads 90 extends along one or more central axes which are parallel to or coincident with a longitudinal axis 94 of print head 40. In other embodiments, print head 40 may include a greater or fewer of such individual print heads 90 which may or may not be staggered and may not be parallel.

FIG. 4 illustrates roller 62 and nozzles 43 of print head 40 with material 70 omitted for purposes of illustration. As shown by FIG. 4, roller 62 is supported by support 60 (shown in FIG. 2) such that axis 76, about which roller 62 rotates, extends substantially parallel to axis 91. As a result, during relative movement of material 70 across roller 62 and print head 40, material 70 interacts with the nozzle plate 45 defining nozzles 43 in the direction indicated by arrows 92 in FIGS. 3 and 4, in a direction perpendicular to the rows or other longitudinal arrangement of nozzles 43. As a result, roller 62 facilitates cross wiping of nozzles 43.

In contrast to parallel wiping, wherein wiping of nozzles 43 occurs in the directions indicated by arrows 93 (shown in FIG. 3), cross wiping of nozzles 43 using pressure applied by roller 62 consumes less time since the shorter width of print head 40 is smaller than the longitudinal length of print head 40 extending along an axis 94. In contrast to parallel wiping where dried fluid behind a point of wiping may provide adhesive and structural reinforcement to the part of the puddle being wiped, such reinforcement is reduced with cross wiping since substantially all of the puddle or residue is removed at roughly the same time. Such cross wiping further reduces the opportunity for dried fluid to be pushed into or adjacent to downstream nozzles 43. In those embodiments in which material 70 is absorbent, the likelihood of color mixing is reduced. In other embodiments, roller 62 may alternatively be supported along a rotational axis 76 that is substantially perpendicular to axis 94 for parallel wiping.

During wiping of nozzles 43, roller 62 presses material 70 against nozzles 43. According to one embodiment, roller 62 is resiliently radially compressible, providing roller 62 some "give" to reduce the likelihood of excessive and, potentially damaging, forces being applied to print head 40. In one embodiment, roller 62 may be formed from a resiliently compressible foam or sponge material. In another embodiment, roller 62 may be formed from one or more polymer materials, providing roller 62 with enhanced durability. In one embodiment, roller 62 may have a substantially uniform outer circumferential surface extending 360 degrees about axis 76. In another embodiment, roller 62 may have an irregular surface providing particular pressure points for supplying precise points of pressure to nozzles 43. For example, roller 62 may include a multitude of radially extending ribs or projections. Such projections may be in the form of actually extending points or teeth, circumferentially and actually spaced bumps or dimples, helically or spirally extending projections, grooves or teeth and the like. In one embodiment, roller 62 may have a cross-sectional shape including two or more lobes. In yet other embodiments, roller 62 may be inflexible or incompressible or may have other configurations.

Roller retainer 66 comprises a mechanism configured to selectively inhibit or substantially retain roller 62 against rotation about axis 76. In one embodiment, roller retainer 66 is configured to retain roller 62 in one or more predetermined angular positions, wherein features, such as projections, along a surface of roller 62 have predetermined positions with respect to print head 40. As a result, positional control over such features of roller 62 may be achieved. For example, in one embodiment in which roller 62 includes radially extending projections, such projections may be positioned and retained correctly opposite to print head 40 or may be positioned and retained so as to not extend opposite to or minimally extend opposite to print head 40, such as when print head 40 is being moved by actuator 42 across roller 62, to reduce a likelihood of damage to print head 40. In one embodiment, roller retainer 66 may comprise a pair of keys or a pair of corresponding projections and detents which may be selectively engaged to lock roller 62 against rotation. In one embodiment, roller retainer 66 may be configured to lock or retain roller 60 in a selected one of many different potential angular orientations. In another embodiment, roller retainer 66 may comprise a selectively actuatable clutch. In one embodiment, roller retainer 66 may be actuated between a retaining state and a released state, permitting rotation of roller 62, in response to control signals from controller 46. In another embodiment, roller retainer 66 may actuate between the retaining state and the released state in response to positioning of roller 62 and support 60 by actuator 68. In still other embodiments, roller retainer 66 may be omitted.

Actuator 68 comprises a mechanism operably coupled to support 60 that is configured to move or translate support 60 and roller 62 between a plurality of positions, wherein roller 62 presses the web of material 70 against print head 40 in at least one of the positions. For example, in one embodiment, actuator 68 may move roller 60 between two positions: a first position in which roller 60 engages in presses material 70 into contact with print head 40 and a second position in which roller 60 is substantially disengaged and out of contact with material 70. According to one embodiment, actuator 68 is configured to translate support 60 and roller 62 to a plurality of positions, at each of which roller 62 presses material 70 against print head 40. The amount of pressure pressing material 70 against print head 40 varies depending upon the positioning of roller 62 by actuator 68.

In one embodiment, actuator 68 may comprise one or more hydraulic or pneumatic cylinder-piston assemblies. In another embodiment, actuator 68 may comprise one or more electric solenoids. In yet other embodiments, actuator 68 may comprise a motor operably coupled to a pinion gear in engaging with a rack gear associated with support 60. In still another embodiment, actuator 68 may comprise a motor operably coupled to a cam in engagement with a cam follower associated with support 60. In other embodiments, actuator 68 may have other configurations or may be omitted such as where roller 62 is supported against material 70 in a fixed or permanent fashion without the opportunity for the translation of support 60. Although printing system 30 is illustrated as including multiple distinct actuators, such as actuators 42, 72 and 68, in other embodiments, the supply of torque or force from such actuators may be consolidated in a fewer number of actuators that employ an appropriate number of drive trains or transmissions to transmit torque or force to each of the noted recipients.

Controller 46 comprises one or more processing units configured to generate control signals directing the operation of at least transport 36, print head 40, actuator 42 and service station 44. With respect to service station 44, controller 46 generates control signals directing the operation of web drive 57, web retainer 58, roller retainer 66 and actuator 68. As noted above, in some embodiments where roller retainer is actuated between different states by actuator 68, controller 46 may indirectly control roller retainer 66 by controlling actuator 68.

For purposes of this application, the term "processing unit" shall mean a presently developed or future developed processing unit that executes sequences of instructions contained in a memory. Execution of the sequences of instructions causes the processing unit to perform steps such as generating control signals. The instructions may be loaded in a random access memory (RAM) for execution by the processing unit from a read only memory (ROM), a mass storage device, or some other persistent storage. In other embodiments, hard wired circuitry may be used in place of or in combination with software instructions to implement the functions described. For example, controller 46 may be embodied as part of one or more application-specific integrated circuits (ASICs). Unless otherwise specifically noted, the controller is not limited to any specific combination of hardware circuitry and software, nor to any particular source for the instructions executed by the processing unit.

FIGS. 5-8 illustrate an example wiping operation being performed upon print head 40 and service station 44 under the direction and control of controller 46 (shown in FIG. 2). As shown in FIG. 5, in response to determining that one or more servicing operations, including wiping, are to be performed upon print head 40, controller 46 generates control signals directing actuator 42 to move carriage 41 (shown in FIG. 2) to position print head 40 substantially opposite to roller 62 on an opposite side of material 70. In one embodiment, controller 46 generates control signals directing actuator 42 to position print head 40 such that a particular individual print head, such as print head 90 shown in Figure) is positioned correctly opposite to axis 76 of roller 62.

As shown in FIG. 6, controller 46 also generates control signals directing actuator 68 (shown in FIG. 2) to translate support 60 along the guide 61 towards print head 40 in the direction indicated by arrow 95. This results in roller 62 also been translated towards print head 40. In the particular example illustrated, controller 46 generates control signals such that actuator 68 moves roller 62 to a position such that material 70 is pressed into contact with print head 40. In the particular example illustrated, roller 62 has a sufficiently large diameter and is sufficiently compressible such that an outer surface of roller 62 compresses such that substantially an entire face of print head 40 is concurrently contacted by material 70. In another embodiment, roller 62 may have a diameter and may be sufficiently incompressible such that a selected width of print head 40 has material 70 pressed against it by roller 62. In such an embodiment, selected individual print heads 90 (such as shown in FIG. 4) may be cleaned or wiped independently of one another depending upon the positioning of print head 40 by actuator 42.

As shown in FIG. 7, controller 46 generates control signals causing material 70 to be moved across roller 62 and across the substantially stationary print head 40 from web supply 52 to web take-up 54 (shown in FIG. 2) in the direction indicated by arrow 96. In the particular example illustrated, controller 46 generates control signals directing web drive 57 (shown in FIG. 2) to pull material 70 in the direction indicated by arrow 97. In other embodiments, alternative or additional rollers may be driven to facilitate movement of material 70. As indicated by arrow 98, during such movement of material 70 across roller 62, roller 62 may rotate about axis 76 as a result of torque transmitted to roller 62 by material 70. During this movement of material 70 across print head 40, cross wiping is performed upon print head 40. Such cross wiping may precede or may be subsequent to spitting, soaking and/or priming operations.

As shown by FIG. 8, after print head 40 has been wiped by material 70, controller 46 generates control signals directing actuator 68 to translate support 60 along guide 61 so as to move or lower roller 62 to position such that an amount of pressure applied by material 70 to print head 40 is reduced. In the particular example illustrated, roller 62 is lowered until material 70 is out of engagement with print head 40. Thereafter, controller 46 may generate control signals directing actuator 42 to move print head 44 priming or spitting operations, for capping or for printing upon media.

FIGS. 9-12 illustrate rollers 162-192, example embodiments of roller 62 shown and described with respect to FIGS. 1-8. Each of rollers 162-192 has a uniform outer circumferential surface. With such rollers, a width of pressure contact area is constrained by print head width such that pressure is regulated by material hardness. According to one embodiment, rollers 162-192 are formed from one or more materials which have a material hardness of between about Shore A 40 and Shore A 70, reducing material fatigue and creep rate. In other embodiments, rollers formed from certain materials may have other hardness levels or characteristics.

To facilitate adequate compression, such rollers 162-192 are provided with spoked geometries. Each of rollers 162-192 includes an annular hub 194, a multitude of resiliently flexible spokes 196 and a resiliently compressible outer wall or ring 198. According one embodiment, each of rollers 162-192 are integrally formed as a single unitary body from one or more polymers, such as urethane. In one embodiment, rollers 162-192 have a uniform cross-sectional shape and are extruded. Because of the relatively complex geometries of rollers from her 162-192, such rollers may be formed with harder more durable materials, such as urethane, to reduce the total force while maintaining or increasing local pressure, to enhance wiping.

Roller 192 is similar to rollers 162-182 except that roller 192 additionally includes projections 199 which radially extend inwardly from wall 198 and are configured to engage spokes 196 during radial compression of roller 192. Projections 199 enhance the ability of roller 190 to provide a more uniform pressure to material 70 and print head 40 during wiping.

Figure 13:
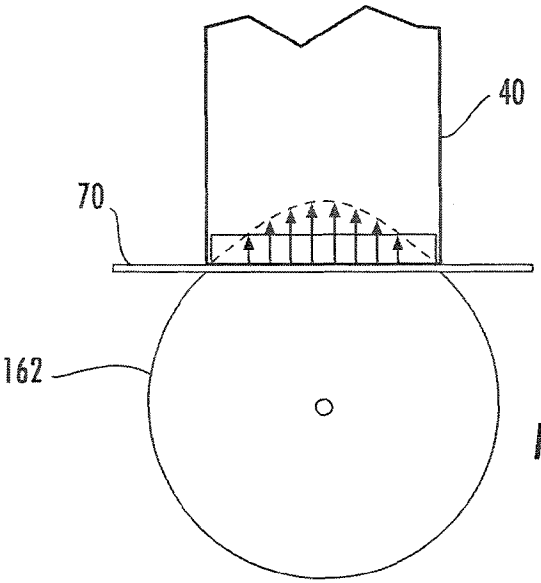
FIG. 13 schematically illustrates the roller of FIG. 9 and its pressure profile during wiping of a print head according to an example embodiment.

FIG. 13 schematically illustrates compression of roller 162 during wiping. FIG. 13 further diagrams a profile of pressure applied across print head 40 by material 70 and the compressed roller 162. As shown by FIG. 13, the pressure applied by roller 162 has a relatively wide distribution across print head 14 during wiping.

Figure 14:
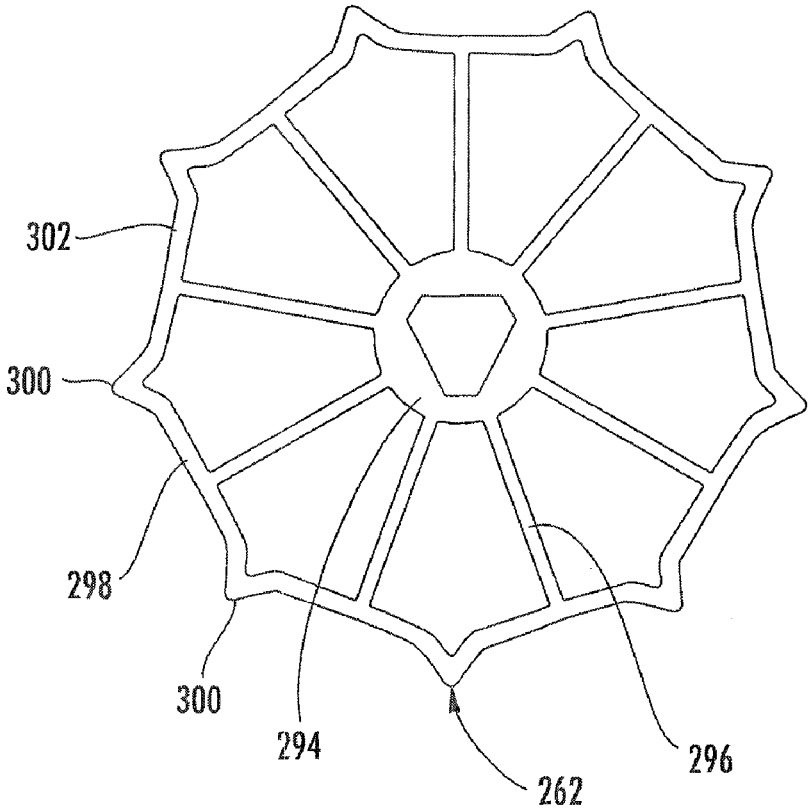
FIG. 14 is an end view of another embodiment of a roller of the service station of FIG. 2 according to an example embodiment.

FIG. 14 is an end view of roller 262, another embodiment of roller 62. Unlike rollers 162-192, roller 262 has a non-uniform outer circumferential surface. In particular, roller 262 includes hub 294, spokes 296, and outer wall 298. Spokes 296 extend radially outward from hub 294 to outer wall 298. Spokes 296 are resiliently compressible in a radial direction. Outer wall 298 encircles hub 294 and includes projections 300 which are circumferentially spaced from one another by valleys or low points 302. In the particular example illustrated in FIG. 14, projections 300 are in the shape of a nipple. According to one embodiment, roller 362 is formed from one or more materials having a hardness of between about Shore A 40 and Shore A 70. According to one embodiment, roller 362 is formed from one or more polymers, such as urethane.

Figure 15:
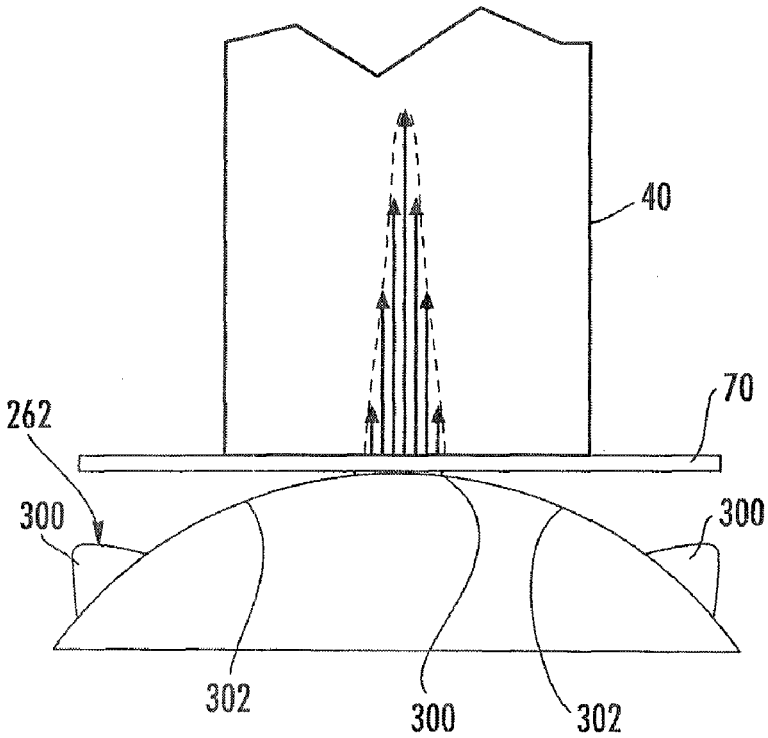
FIG. 15 schematically illustrates the roller of FIG. 14 and its pressure profile during wiping of a print head according to an example embodiment.

FIG. 15 schematically illustrates compression of roller 262 during wiping. FIG. 15 further diagrams a profile of pressure applied across print head 40 by material 70 in the compressed roller 262. As compared to roller 162 and its pressure profile diagrammed in FIG. 13, roller 262 has a much more concentrated pressure profile. As a result, roller 262 has a decreased contact area, applying a much higher peak or localized pressure for a same amount of force. This higher peak pressure facilitates enhanced wiping of print head 40 as it is swept across print head 40. In the example illustrated, the peak pressure applied by projection 300 during wiping a showing FIG. 15 is between about 0.02 Mpa (mega-Pascal) and 20 Mpa, and nominally about 0.2 Mpa. The average pressure applied across the area is between about 0.01 Mpa and about 10 Mpa, and nominally about 0.1 Mpa.

In other embodiments, roller 262 and its projections 300 may have other configurations and may be configured to apply different average and peak pressures to print head 40. Although projections 300 are illustrated as comprising pinched portions of outer wall 298 to form nipples, in other embodiments, projections 300 may have tips with other shapes. For example, wall 298 may alternatively include linear segments uniformly sloping from a juncture of spoke 296 to a peak or point of projection 300. Although low points 302 are illustrated as being substantially flat between projections 300, in other embodiments, low points 302 may be convex or concave. Although roller 262 is illustrated as including nine projections angularly spaced from one another by approximately 40 degrees, in other embodiments, roller 262 may include a greater or fewer of such projections 300 at different angular spacings.

Figure 15A:
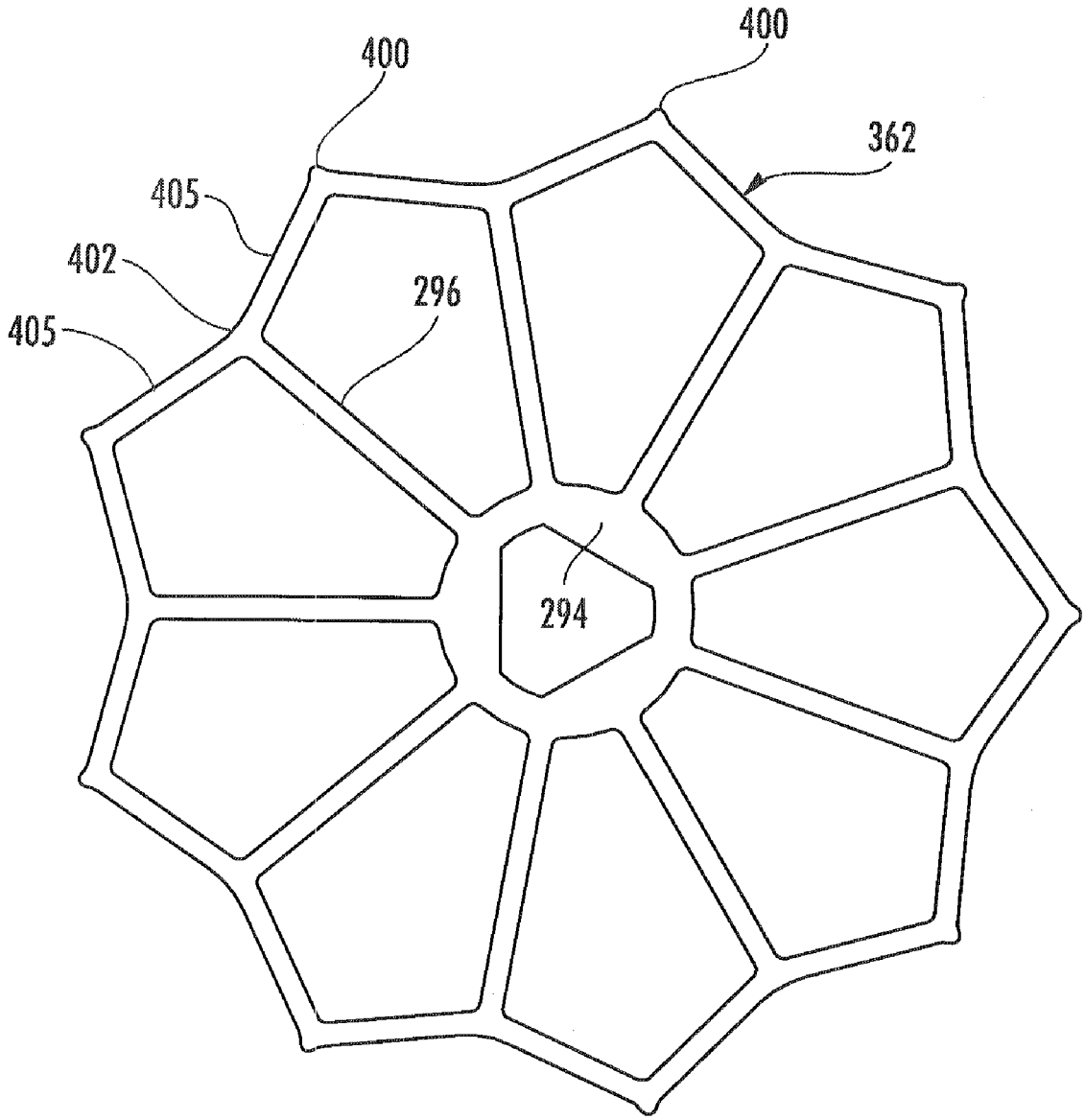
FIG. 15A is an end view of another embodiment of the roller of the service station of FIG. 2 according to an example embodiment.

FIG. 15A is an end view of roller 262, another embodiment of roller 62. Like roller 262, roller 362 has a non-uniform outer circumferential surface. Roller 362 is similar to roller 262 except that outer wall 398 of roller 362 includes projections 400 and low point 402 in lieu of projections 300 and low points 302. Like projections 300, projections 400 have a decreased contact area, providing higher local pressures for the same force. Like projections 300, projections 400 actually extend long substantially an entire axial length of roller 362. However, as compared roller 262, roller 362 includes a pair of substantially planar segments 405 between projections 400 that gradually incline or ramp from low point 402 to projections 400. As a result, projections 300 have a smaller contact radius during a static wipe when roller 262 is in the position shown in FIG. 15. At the same time, projections 300 maintain a smaller angle of incidence to reduce collision forces between roller 262 and print head 40 when print head 40 is being moved during wiping (a "dynamic" wipe).

FIGS. 16-19 schematically illustrate different print head servicing modes (also known as "primitives") that may be performed by service station 44 (shown in FIG. 2). FIGS. 16-19 illustrate service station 44 including roller 362 in lieu of roller 62. In other embodiments, roller 362 in FIGS. 16-19 may be replaced with roller 262 or other rollers.

Figure 16:
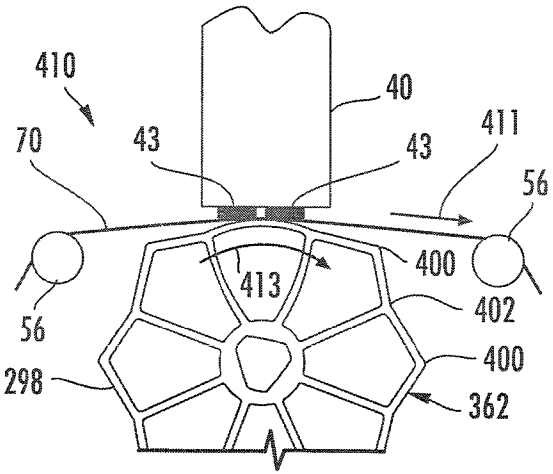
FIG. 16 schematically illustrates a static wiping mode according to an example embodiment.

FIG. 16 illustrates a static wiping mode 410. In such a static wiping mode, print head 40 is substantially stationary as material 70 is moved across nozzles 43 as indicated by arrow 411. At the same time, roller 362 is translated to a position opposite to print head 40 by actuator 68 (shown in FIG. 2) and roller retainer 66 (shown in FIG. 2) is in an inactive state. As a result, roller 362 is compressed as it presses material 70 against nozzles 43. As discussed above, projections 400 provide a higher peak pressure and larger average pressure across a smaller area with the same amount of force, enhancing wiping of nozzles 43. As indicated by arrow 413, as material 70 is pulled across roller 362, roller 362, which is in an idling state, may rotate from torque applied by the movement of material 70. As a result, projections 400 may be swept across nozzles 43 of print head 40.

Figure 17:
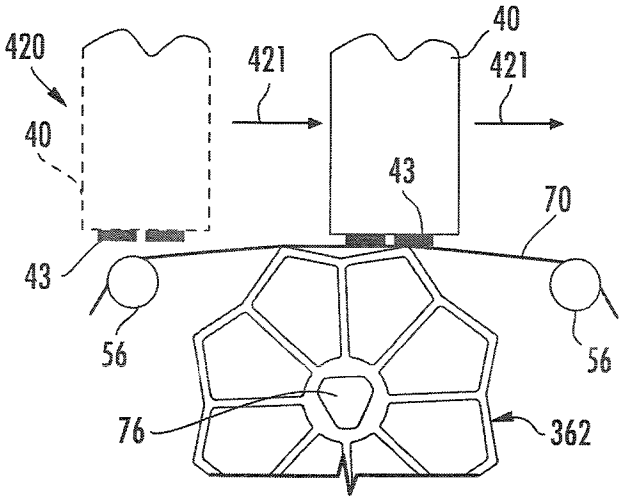
FIG. 17 schematically illustrates a dynamic wipe mode according to an example embodiment.

FIG. 17 schematically illustrates a dynamic wipe mode 420 wherein actuator 42 (shown in FIG. 2) is moving print head 40 across material 70 and across roller 362 as indicated by arrow is 421. In the example illustrated, actuator 68 has moved roller 62 such that roller 62 presses material 70 against nozzles 43 to effectuate wiping. However, during such a dynamic wipe mode, the angular positioning of roller retainer 66 is controlled and set to a predetermined orientation. In particular, roller retainer 66 (schematically shown in FIG. 2) sets the angular positioning of roller 62 with respect to axis 76. In one embodiment, roller retainer 66 (schematically illustrated in FIG. 2) sets the angular positioning or orientation of roller 362 such that peaks of projections 400 facing material 70 are at their lowest points with respect to material 70. In the embodiment illustrated, such occurs when that portion of outer walls 298 of roller 362 having the shortest radius with respect to axis 76 is proximate or coincident with a radial line extending from axis 76 substantially perpendicular to material 70 and a direction 421 in which print head 40 is moved relative to roller 362. In the particular example illustrated, projections 400 are symmetrically located about a vertical line extending substantially perpendicular to print head 40.

According to one embodiment, the predetermined angular orientation of roller 362 is established when or while roller 362 is in a lowered position out of engagement with material 70. For example, in one embodiment, the angular orientation of roller 362 is indexed to a certain orientation by a roller retainer 66 (schematically shown in FIG. 2) when lowered into engagement with an indexing structure of roller retainer 66 (not shown). Although roller 362 is disengaged from the indexing structure when raised, the angular orientation of roller 362 is maintained until roller 362 is brought into engagement with material 70. Because the web of material 70 is in tension over projections 400 that are at their lowest points, material 70 inhibits rotation of roller 362.

According to another embodiment, roller 362 may be indexed and angularly retained against rotation by roller retainer 66 while it is being raised into engagement with material 70. In one embodiment, roller 362 may also be retained against rotation by roller retainer 66 while it is in engagement with material 70 when in the dynamic wipe mode. In one embodiment, web retainer 58 is also actuated to an active state, inhibiting unwinding of material 70 from web supply 52 (shown in FIG. 2) as print head 40 wipes against material 70.

Because the extent to which projections 400 of roller 362 extend upward (as seen in FIG. 17) towards and into the path of print head 40 is reduced or minimized, the likelihood of a potentially print head damaging collision between nozzles 43 print head 40 and roller 362 to remove in a print head 40 is also reduced. As a result, nozzles 43 of print head 40 may be quickly and effectively wiped as print head 40 flies by and across roller 362. Because print head 40 may be wiped in transit without stopping or pausing movement of print head 40, print head 40 may be wiped more frequently without a substantial reduction in the throughput (output per time) of printing system 30. More frequent wiping of nozzles 43 may be beneficial since it has been found that it is more effective to frequently remove a little bit of wet ink or fluid than it is to occasionally remove a greater amount of dried ink or fluid. Moreover, the above-noted dynamic wipe has not been found to cause or create bubbles in print head 40. Frequent dynamic wipes further improves throughput of printing system 20 by reducing a number of times that a static cross wipe as described in FIG. 16 is performed.

As illustrated in FIGS. 16 and 17, the amount of pressure applied by roller 362 (or any other roller having projections) against nozzles 43 of print head 40 may vary depending upon either (1) the height or relative spacing of roller 362 with respect to material 70 and print head 40 and the angular orientation of roller 362. In the static mode, the relative spacing is controlled. In the dynamic mode, both the relative spacing and the angular orientation may be controlled.

As noted above, in one embodiment, roller 362 may be actuatable between only two states: an engaged state in which roller 362 engages material 70 and print head 40 and a disengaged state. In such an embodiment, the profile of roller 362 may be configured such that projections 400 (or other projection configurations) have appropriate dimensions and spacings such that projections 400 provide an enhanced pressure profile for wiping nozzles 43 in both the static wiping mode and the dynamic wiping mode when roller 362 is positioned in the single engaged state. Such a two-state configuration for positioning of roller 362 may reduce cost and complexity of actuator 68 (shown in FIG. 2). In yet other embodiments, actuator 68 may alternatively be configured to move roller 362 between multiple positions with respect to print head 40, wherein roller 362 engages material 70 and print head 40 in multiple positions.

According to one embodiment, the height or relative spacing between the rotational axis 76 of roller 362 and material 70 as well as print head 40 is substantially constant during actual wiping of print head 40. In other words, once moved to the engaged position or state, roller 362 is not substantially translated as material 70 is moved across roller 362 in the static wiping mode in FIG. 16 or as print head 40 is moved across roller 362 in the dynamic wiping mode. In other embodiments, the height or relatives spacing between the rotational axis 76 of roller 362 and print head 40, as adjusted by actuator 68 (shown in FIG. 2) may be varied during actual wiping.

For example, in one embodiment, the spacing of roller 362 with respect to print head 40 may be varied and controlled based upon the angular positioning of roller 362 as it is being rotated by material 70 during static wiping. In particular, the angular positioning of roller 362, as it is being rotated by movement of material 70 during static wiping, may be determined using the determine positioning of material 70, such as from an encoder associated with web drive 56 (shown in FIG. 2). Using the determined positioning of material 70 to determine the angular positioning of roller 362, controller 46 (shown in FIG. 2) may generate control signals directing actuator 68 (shown in FIG. 2) to adjust, in a synchronous fashion or in an asynchronous fashion, the height or relative positioning of the axis 76 of roller 362 with respect to print head 40 during static wiping.

In another embodiment, the spacing of roller 362 with respect to print head 40 may be varied and controlled based upon the positioning of print head 40 as print head and 40 is being moved across roller 362 during wiping in the dynamic wiping mode. In particular, the positioning of print head 40 may be determined using one or more sensors which directly sense the positioning of print head 40 or which sense motion supplied by actuator 42 (shown in FIG. 2). Using the determined positioning of print head 40 as it is being moved across roller 362, controller 46 (shown in FIG. 2) may generate control signals directing actuator 68 (shown in FIG. 2) to adjust, in a synchronous fashion or in an asynchronous fashion, the height or relative positioning of roller 362 with respect to print head 40 during wiping in the dynamic wiping mode.

Figure 18:
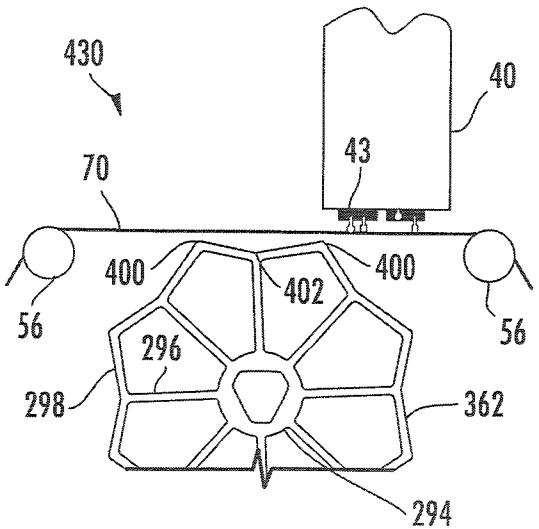
FIG. 18 schematically illustrates a spitting and/or a priming mode according to an example embodiment.

FIG. 18 illustrates a spitting and/or priming mode 430 according to an example embodiment. As shown by FIG. 18, print head 40 is positioned by actuator 42 (shown in FIG. 2) opposite to material 70. Roller 362 is translated by actuator 68 to a position out of engagement with material 70. In other embodiments, roller 362 may remain positioned against material 70. In one embodiment, material 70 is stationarily supported across supports 56 during this operation. In other embodiments, actuator 72 (shown in FIG. 2) may move material 70 across supports 56.

As shown by FIG. 18, according to one method of operation, such spitting in priming may be performed while print head 40 is substantially stationary. In such a mode, print head 40 is positioned opposite to a portion of material 70 that has already been used for wiping, generally downstream from where roller 362 is directly opposite to material 70. Consequently, portions of material 70 that have already been used for wiping, but which may still be absorbent, may be used for priming and spitting. In other embodiments, such priming and spitting may be performed while print head 40 is in transit or is moving across material 70.

In the particular example illustrated, spitting is achieved by firing nozzles 43 to eject fluid onto material 70. Priming is performed by supplying pressurized air within print head 40 to force fluid through nozzles 43. Such priming is generally not impaired by air bubbles that may exist in the firing chambers of nozzles 43.

Figure 19:
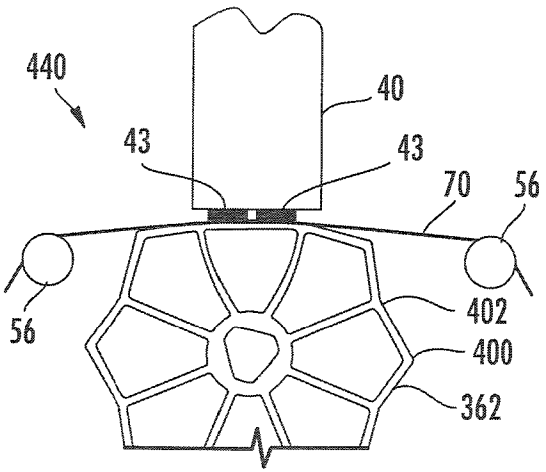
FIG. 19 schematically illustrates a soak mode according to an example embodiment.

FIG. 19 illustrates a soaking mode 440 according to an example embodiment. In the soaking mode, print head 40 is moved by actuator 42 (shown in FIG. 2) to a stationary position substantially opposite to roller 362. Roller 362 is moved by actuator 68 into contact with material 70 so as to press material 70 against print head 40. In the particular example illustrated, roller 362 is moved such that roller 362 is compressed to a greater extent as compared to compression of roller 362 during a static wipe mode as shown in FIG. 16. As a result, a greater portion or area of nozzles 43 are concurrently brought into contact with material 70. In other embodiments, roller 362 may be compressed to a greater or lesser extent. In other embodiments, roller 362 may remain out of contact with material 70 during such soaking.

According to one embodiment, material 70 is prepared for soaking by depositing one or more cleaning fluids that facilitate removal of dried fluid residue from nozzles 43 onto material 70. Material 70 absorbs and retains the one or more cleaning fluids. In the example illustrated, controller 46 (shown in FIG. 2) directs print head 40 to eject fluid (through spitting or priming) onto material 70 prior to contacting material 70 or while in contact with material 70. In one embodiment, the fluid ejected by print head 40 includes one or more solvents or humectants, wherein the solvents or humectants serve as a cleaning fluid to assist in removal of dried fluid or ink upon nozzles 43. After a sufficient period of soaking time has elapsed, print head 40 may undergo one or more of the operations described in FIGS. 16-18.

As shown by FIGS. 16-19, material 70 and roller 362 (or other above-described rollers) may be used to perform any one of multiple servicing operations on nozzles 43 of print head 40. These multiple operations may be performed using a single module or assembly of the material 70 and roller 362. As a result, the complexity, cost and size of service station 44 and of printing system 30 may be reduced.

Figure 20:
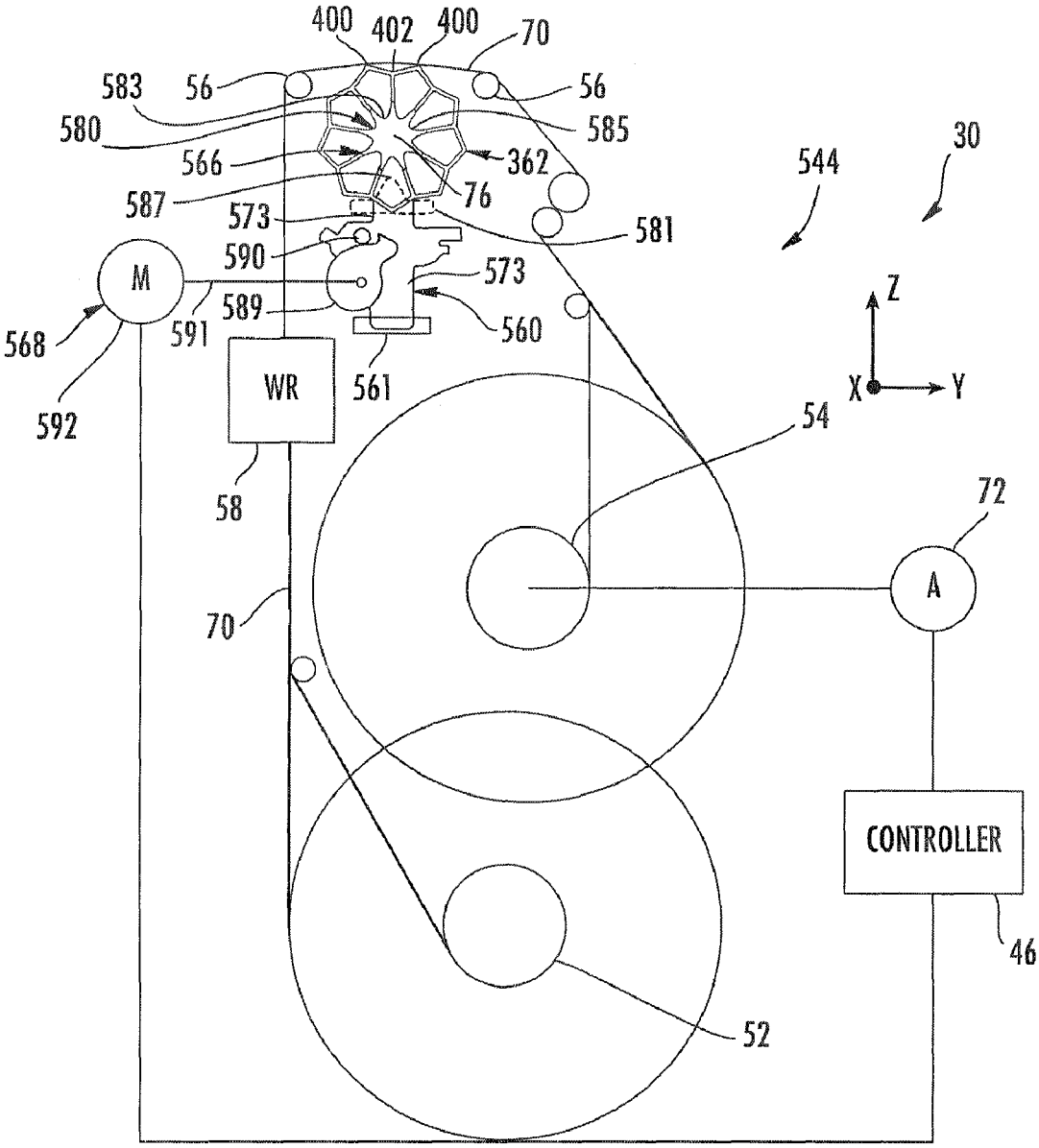
FIG. 20 is a front view illustrating another embodiment of the service station of FIG. 2 according to an example embodiment.
Figure 21:
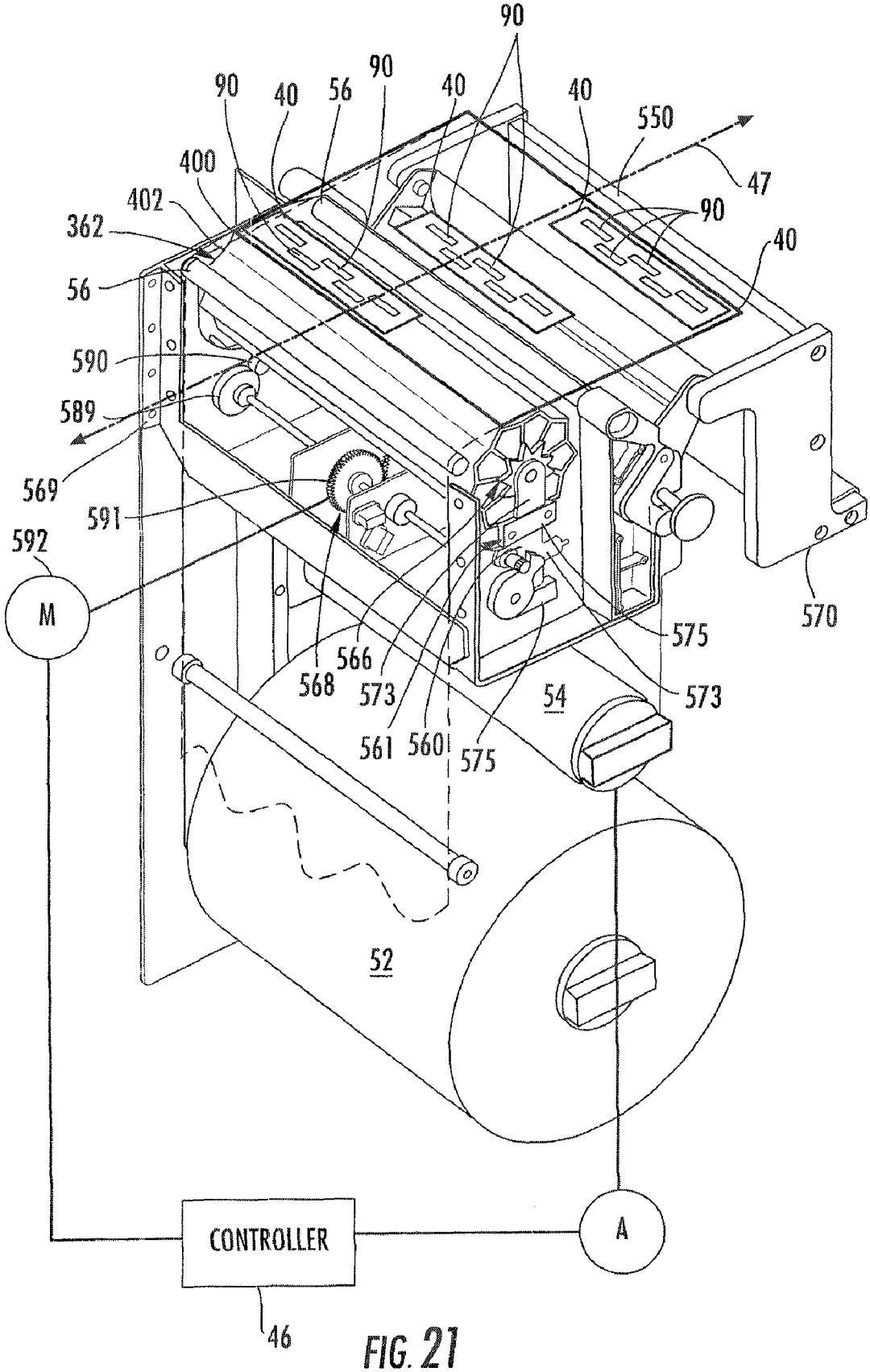
FIG. 21 is an enlarged perspective view of the service station of FIG. 20 according to an example embodiment.
Figure 22:
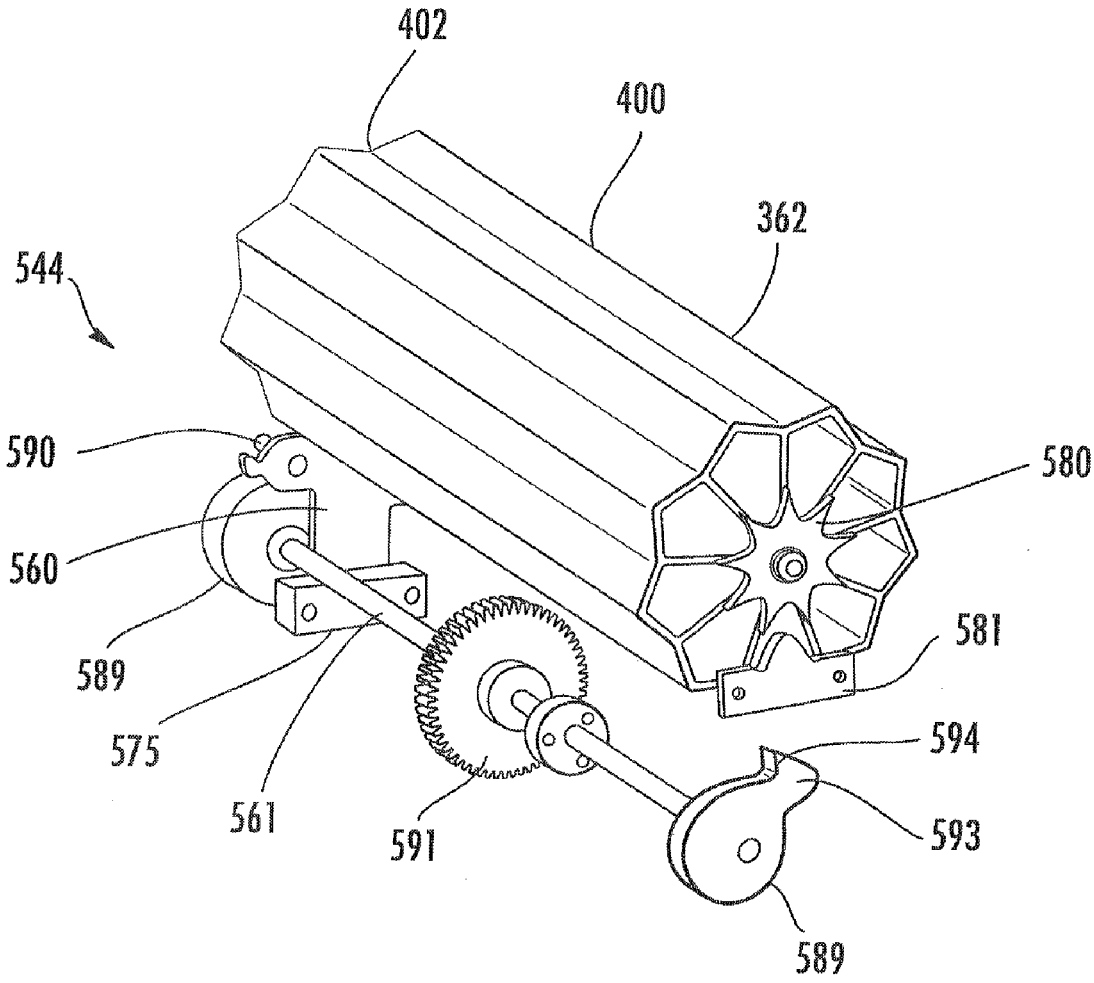
FIG. 22 is a perspective view of a portion of the service station of FIG. 21 illustrating a roller retainer of the service station of FIG. 20 in a releasing state according to an example embodiment.

FIGS. 20-23 illustrate service station 544, another embodiment of service station 44 shown in FIG. 2. As shown by FIGS. 21 and 22, service station 544 includes housing 550, web supply 52, web take-up 54, web supports 56, web retainer 58, roller support 560, guide 561, roller 362, roller retainer 566, actuator 568, material 70 and web drive 57. Web supply 52, web take-up 54, Web supports 56, web drive 57, web retainer 58, material 70 and web drive 57 are each described above with respect to service station 44 in FIG. 2. Roller 362 is described above with respect to FIG. 16. In other embodiments, surface station 544 may alternatively include other rollers, such as roller 262. Service station 544 is similar to service station 44 except that service station 544 includes roller support 560, guide 561, roller retainer 566 and actuator 568 in lieu of roller support 60, guide 61, roller retainer 66 and actuator 68, respectively. Service station 544 is additionally illustrated as including housing 550.

Housing 550 (shown in FIG. 21) comprises one or more structures supporting components of service station 544. As shown by FIG. 21, housing 550 includes a main portion 569 and a movable portion 570. Main portion 569 is substantially stationary and supports each of the components of service station 544. Moveable portion 570 comprises a portion of housing 550 movable with respect to main portion 569. Movable portion 570 carries and supports one of web supports 56 which assist in maintaining material 70 in tension. Movable portion 570 moves between an enclosing position and an access providing position (shown in FIG. 21). In the enclosing position, the support 56 carried by movable portion 570 pinches material 70 against other supports 56 to assist in maintaining material 70 in tension. In the access providing position shown in FIG. 21, movable portion 570 is moved away from those supports 56 supported by main portion 569, providing a person with access to the space between supports 56. In the access providing position, movable portion 570 provides a person with enhanced axis to assist a person in loading material 70. In the particular embodiment illustrated, movable portion 570 is pivotally coupled to main portion 569 so as to pivot between the enclosing position and the access providing position. In other embodiments, portion 570 may be disconnectable from main portion 569 or may be slidable or otherwise movable with respect to main portion 569 for providing such axis. In yet other embodiments, portion 570 may alternatively be immovable or fixed with respect to main portion 569.

Roller support 560 is similar to roller support 60 in that roller support 560 rotationally supports roller 362 for rotation about axis 76. Guide 561 is similar to guide 61 in that guide 561 guides movement of roller support 560 (and roller 362) between a plurality of positions, wherein roller 362 presses material 70 against a print head, such as print head 40 shown in FIG. 2, in at least one of the plurality of positions. In the particular example illustrated, roller support 560 includes a pair of substantially linear bar-shaped portions 573 which are slidably received within channels provided by a pair of a channel defining members 575 forming guide 561. In other embodiments, support 560 and guide 561 may have other configurations.

Roller retainer 556 comprises a mechanism configured to selectively inhibit or substantially retain roller 362 against rotation about axis 76. In one embodiment, roller retainer 566 is configured to retain roller 362 in one or more predetermined angular positions, wherein features, such as projections, along a surface of roller 362 have predetermined positions with respect to print head 40 (shown in FIG. 2). As a result, positional control over such features of roller 362 may be achieved. In the example illustrated in which roller 362 includes radially extending projections 400, such projections 400 may be positioned and retained directly opposite to print head 40 or may be positioned and retained so as to not extend opposite to or minimally extend opposite to print head 40, such as when print head 40 is being moved by actuator 42 (shown in FIG. 2) across roller 362, to reduce a likelihood of damage to print head 40.

Figure 23:
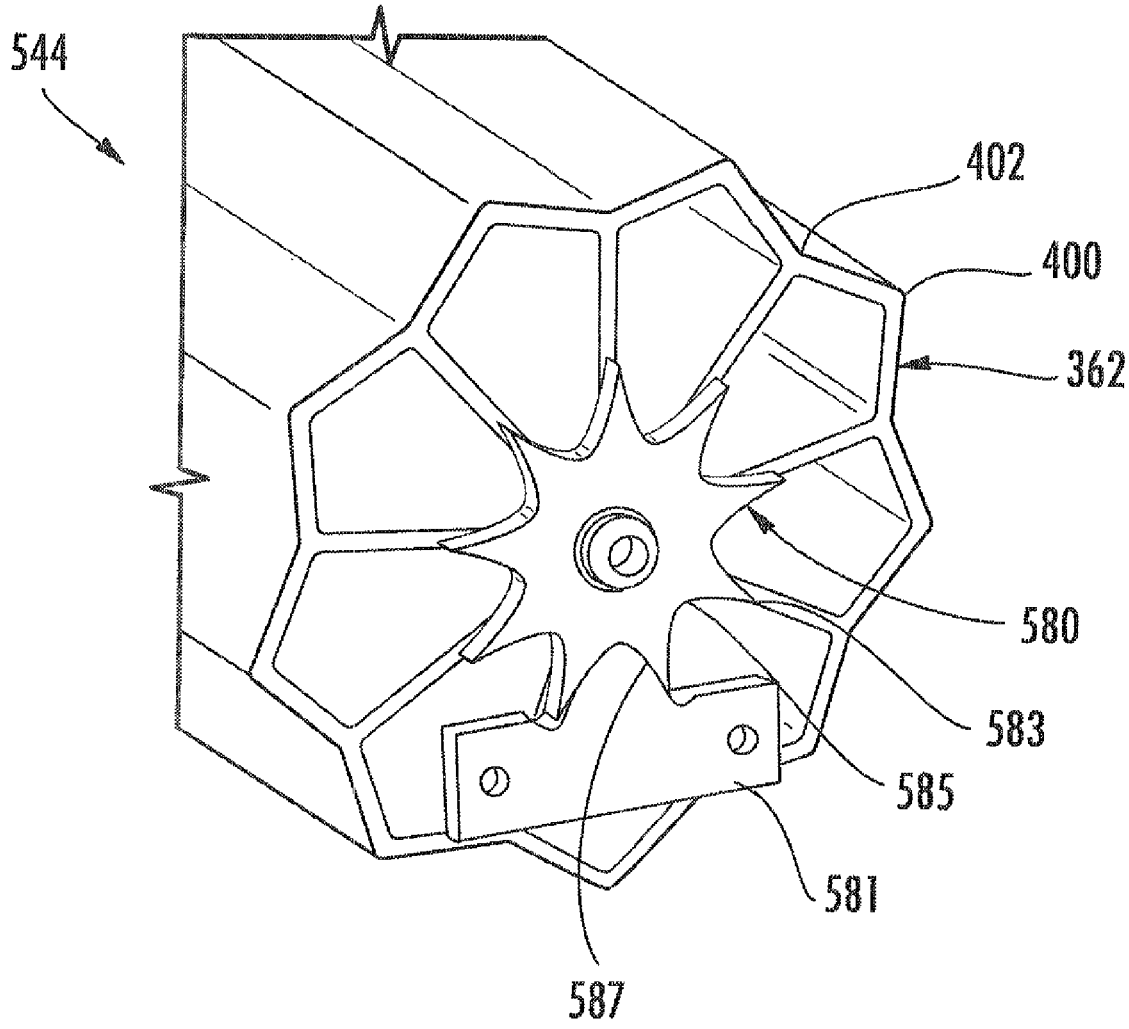
FIG. 23 is a fragmentary perspective view of a portion of the service station of FIG. 22 illustrating the roller retainer in a retaining state according to an example embodiment.

As shown by FIGS. 20 and 22-23, roller retainer 566 includes a pair of keys 580 and 581 having a pair of corresponding projections and detents which may be selectively engage one another to retain roller 62 against rotation. In the particular example illustrated, key 580 comprises a multi-pointed star affixed to roller 362 so as to rotate with roller 362. Consecutive points 583 of the star are separated by an intermediate V-shaped notch 585. Key 581 comprises a V-shaped projection 587 fixed in a stationary manner and supported by main portion 569. In other embodiments, keys 580 and 581 may have other mating or interlocking configurations. For example, in another embodiment, key 580 may include a projection that is received within a corresponding detent of key 581.

FIG. 22 illustrates keys 580 and 581 in a disengaged state such that roller retainer 566 is in a released state in which roller 362 and key 580 are idling or freely rotating in the absence of external forces. FIG. 23 illustrates keys 580 and 581 in an engaged state such that roller 362 is in a retaining state in which rotation of roller 362 and keys 580 is impeded. As will be described hereafter, engagement and disengagement of keys 580 and 581 is dependent upon the positioning of roller 362 along the Z-axis (carrying key 580) with respect to main portion 569 of housing 550 (carrying key 581) as controlled by actuator 568.

Actuator 568 comprises a mechanism operably coupled to support 560 that is configured to move or translate support 560 and roller 362 between a plurality of positions, wherein roller 362 presses the web of material 70 against print head 40 (shown in FIG. 2) in at least one of the positions. According to one embodiment, actuator 68 is configured to translate support 560 and roller 362 to a plurality of positions at which roller 362 presses material 70 against print head 40. The amount of pressure pressing material 70 against print head 40 varies depending upon the positioning of roller 62 by actuator 68.

In the particular example illustrated, actuator 568 includes cams 589, cam followers 590, transmission 591 and motor 592. Cams 589 are rotationally supported on opposite ends of roller 362 in engagement with corresponding cam followers 590 which extend from associated roller supports 560. As shown by FIGS. 20 and 22, each cam 589 has an inner or outer profile bearing against cam follower 590 such that rotation of each cam 589 against cam follower 590 results in linear movement of cam follower 590, roller support 560 and roller 362 as directed by corresponding guides 561. In other embodiments, cam 589 may effectuate non-linear movement.

As further shown by FIGS. 20 and 22, each cam 589 additionally includes a hook 593 providing a stop surface 594. Stop surface 594 limits further movement of cam follower 590 along cam 589 to provide a positive indication of when roller supports 560 and roller 362 have been moved to the limit of travel. As a result, the extent to which roller 362 is moved towards material 70 and print head 40 (shown in FIG. 2) may be precisely controlled. In other embodiments, hook 593 may be omitted from each cam 589 such as when motor 592 includes a servo or encoder for tracking and controlling the angular position of cam 589 and the corresponding position of roller 362.

Transmission 591 comprises a drive train operably connecting motor 592 to both of cams 589. Transmission 591 may comprise a gear train, a belt and pulley arrangement, a chain and sprocket arrangement or combinations thereof. Motor 592 comprises a motor configured to supply torque to cams or 589. In one embodiment, motor 592 comprises a DC motor. In other embodiments, other torque sources may be employed. In other embodiments, transmission 591 may be omitted where a direct drive is employed, such as a drive that utilizes a stepper motor.

Although actuator 568 is illustrated as including a pair of such cams 589 and cam followers 590, in other embodiments, actuator 568 may include a single cam and cam follower. In still other embodiments, actuator 568 may comprise other mechanisms configured to move roller support 560 and roller 362. Although actuator 568 is illustrated as including a dedicated motor 592, in another embodiment, rotation of the one or more cams 589 may be achieved using torque supplied more from other sources used for driving other components of service station 544 or other components of printing system 30.

Overall, service station 544, like service station 44, is well-suited for cleaning a print head, such as print head 40 (shown in FIG. 2. Service station 544 is actuated between multiple servicing modes. Like service station 44, service station 544 may be operated in each of the modes described above in FIGS. 16-19. As a result, service station 544 may more frequently wipe and service print heads without substantially sacrificing printing throughput.

The ability of service stations 44 and 544 to effectively wipe and service one or more print heads without sacrificing printing throughput facilitates use of service stations 44 and 544 in printing systems having relatively long printing swaths. This ability further facilitates use of service stations 44 and 544 and printing systems that deposit inks or fluids that are designed to have an enhanced adhesion to polymeric media. Because such inks or fluids are designed to be especially stick or adhere to polymers, such inks or fluids also tend to adhere or stick to the nozzle plates of the one or more print heads which may also be formed from one or more polymers. The enhanced wiping effectiveness of service stations 44 and 544 address these issues.

According to one example embodiment, service stations 44 and 544 may be employed in printing system 30 (schematically shown in FIG. 1). In one embodiment, printing system 30 is configured to print an ink having enhanced adhesion with polymers, such as vinyl. In one embodiment, printing system 30 is further configured to print in swaths across the polymeric media having a length of greater than 2 m and nominally about three minute meters. In one application, printing is performed on vinyl building wraps comprise a multiple strips come each strip having a width of about 3 m. In such an embodiment, each roller (62, 262, 362) has a diameter of between about 1 inch and 10 inches and nominally about three inches to about 4 inches. In one embodiment, service station 44 includes seven such rollers positioned end-to-end, with each roller having a length of about 34 mm. In other embodiments, a greater or fewer of such rollers having longer or shorter individual lengths may be provided so as to have a sufficient collective length for servicing the one or more print heads. Although service stations 44 and 544 are well-suited for such printing applications, features of service stations 44 and 544 may also be used in other larger or smaller scale printing systems.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An apparatus comprising:

a web of wiping material configured to extend opposite a print head on a first side of the web;

a roller having a rotational axis on a second opposite side of the web; and at least one actuator configured to translate the roller between a plurality of different positions in which the rotational axis of the roller is spaced from the print head by different respective spacings, each of the different respective spacings occurring while the roller presses the web against the print head.

2. The apparatus of claim 1, wherein the roller is radially resiliently compressible.

3. The apparatus of claim 2, wherein the roller has an outer surface formed from one or more polymeric materials.

4. The apparatus of claim 2, wherein the roller has a uniform circumferential surface extending 360 degrees about an axis of the roller.

5. The apparatus of claim 2, wherein the roller has an irregular outermost circumferential surface.

6. The apparatus of claim 5, where the roller has circumferentially spaced outermost resiliently deformable projections.

7. The apparatus of claim 1, wherein the roller is supported along an axis substantially parallel to an axis of the print head.

8. The apparatus of claim 1, wherein the at least one actuator is configured to move the web across the roller.

9. The apparatus of claim 1, wherein the roller is actuatable between a first state in which the roller idles and freely rotates in the absence of external forces and a second state in which the roller is fixed against rotation.

10. The apparatus of claim 9, wherein the roller includes outermost circumferentially spaced radial projections and a radial low point between the projections and wherein the radial low point is retained in place opposite the print head when the roller is in the second state.

11. The apparatus of claim 10, wherein the at least one actuator is configured to move the roller between a first position in which the roller presses the web against the print head while the roller is in the first state and a second position in which the roller presses the web against the print head while the roller is in the second state.

12. The apparatus of claim 10 further comprising:

a print head; and a controller configured to generate first control signals when the roller is in a first state and second control signals when the roller is in the second state, wherein the at least one actuator positions the print head substantially opposite the roller and substantially stationary with respect to the roller in response to the first control signals and moves the print head relative to the roller in response to the second control signals.

13. The apparatus of claim 12 further comprising a web retainer configured to retain the web against movement while the print head is being moved relative to the roller.

14. The apparatus of claim 1 further comprising:

a first key coupled to the roller to rotate with the roller; and a second fixed key, wherein the second fixed key engages the first key in one of the plurality of positions to retain the roller against rotation.

15. A method comprising:

moving a print head across a first side of a web while the web is pressed against the print head by a roller having resiliently deformable outermost radial projections on a second side of the web to wipe the print head; and retaining the radial projections in place as the print head is moved across the web.

16. The method of claim 15 further comprising translating a rotational axis of the roller relative to the print head based upon at least one of an angular position of the roller as the roller is rotating or a position of the print head as the print head is moving across the roller.

17. The method of claim 15, wherein the radial projections are spaced by an intermediate radial low point and wherein the radial low point extends opposite the print head while the print head is moved across the web.

18. The method of claim 15 further comprising linearly translating a rotational axis of the roller.

19. The method of claim 15 further comprising moving the web across the roller while the roller is idling and while the web is in contact with the print head opposite the roller.

20. The apparatus of claim 1, wherein the at least one actuator moves the rotational axis of the roller along multiple linear segments or along an arcuate path.

21. The method of claim 16, wherein translating the roller comprises linearly moving the rotational axis of the roller in a direction perpendicular to a face of the print head while the web is pressed against the face of the print head based upon the at least one of the angular position of the roller as the roller is rotating or the position of the print head as the print head is moving across the roller.

* * * * *